US007766068B2

(12) United States Patent
Andersen

(10) Patent No.: US 7,766,068 B2
(45) Date of Patent: Aug. 3, 2010

(54) ADJUSTABLE BOTTOM RAIL FOR VENETIAN BLINDS AND USE OF ADJUSTMENT MEANS THEREFOR

(75) Inventor: Torben Mayer Andersen, Svendborg (DK)

(73) Assignee: Faber A/S, Ryslinge (DK)

( * ) Notice: Subject to any disclaimer, the term of this patent is extended or adjusted under 35 U.S.C. 154(b) by 0 days.

(21) Appl. No.: 11/817,254

(22) PCT Filed: Mar. 1, 2006

(86) PCT No.: PCT/DK2006/000121

§ 371 (c)(1),
(2), (4) Date: Aug. 26, 2008

(87) PCT Pub. No.: WO2006/092142

PCT Pub. Date: Sep. 8, 2006

(65) Prior Publication Data

US 2009/0139666 A1 Jun. 4, 2009

(30) Foreign Application Priority Data

Mar. 2, 2005 (DK) ..... PA 2005 00313

(51) Int. Cl.
*E06B 9/388* (2006.01)
*E06B 9/00* (2006.01)

(52) U.S. Cl. ..... 160/173 R; 160/178.1 R

(58) Field of Classification Search ..... 160/168.1 R, 160/172 R, 173 R, 176.1 R, 177 R, 178.1 R
See application file for complete search history.

(56) References Cited

U.S. PATENT DOCUMENTS 2,508,742 A * 5/1950 Bell ..... 160/173 R
2,627,917 A * 2/1953 Lind ..... 160/173 R
2,756,816 A * 7/1956 Radel et al. ..... 160/173 R
2,861,631 A * 11/1958 Anderle ..... 160/173 R
4,177,853 A * 12/1979 Anderson et al. ..... 160/168.1 R
4,202,395 A * 5/1980 Heck et al. ..... 160/84.06
4,224,974 A * 9/1980 Anderson et al. ..... 160/178.1 R
4,722,382 A * 2/1988 Vecchiarelli ..... 160/178.1 R
4,727,921 A * 3/1988 Vecchiarelli ..... 160/168.1 R
4,886,102 A * 12/1989 Debs ..... 160/177 R
5,655,590 A * 8/1997 Bryant ..... 160/168.1 R
5,765,621 A * 6/1998 Bryant ..... 160/168.1 R
5,918,656 A * 7/1999 Daniels et al. ..... 160/168.1 R
5,927,366 A * 7/1999 Bryant ..... 358/1.15
6,024,154 A * 2/2000 Wang et al. ..... 160/170
6,044,889 A * 4/2000 Liu ..... 160/172 R
6,053,236 A * 4/2000 Judkins et al. ..... 160/168.1 R
6,059,004 A * 5/2000 Oskam ..... 160/84.04
6,062,292 A * 5/2000 Bryant ..... 160/178.1 R
6,119,757 A * 9/2000 Judkins et al. ..... 160/178.1 R
6,131,640 A * 10/2000 Judkins ..... 160/168.1 R
6,302,183 B1 * 10/2001 Judkins et al. ..... 160/178.1 R
6,675,861 B2 * 1/2004 Palmer et al. ..... 160/170

(Continued)

*Primary Examiner*—Katherine W Mitchell
*Assistant Examiner*—Jaime F Cardenas-Garcia
(74) *Attorney, Agent, or Firm*—Pearne & Gordon LLP

(57) ABSTRACT

Known bottom rails fulfill the requirements stiffness and adjustability at the time of installation, but a noted inequality in the load on the individual raising cord cannot be corrected without a complex dismantling of the bottom rail. According to the invention the bottom rail is suspended in clips (7) that on the one hand holds the lowermost slat (5) and the raising cords (4), on the other hand has means (10) so that the tightening of the raising cords may be adjusted individually.

7 Claims, 4 Drawing Sheets

U.S. PATENT DOCUMENTS

| | | | | |
|---|---|---|---|---|
| 6,796,360 | B2 * | 9/2004 | Ferrie et al. | 160/172 R |
| 7,178,576 | B2 * | 2/2007 | Nien et al. | 160/168.1 R |
| 2004/0163775 | A1 * | 8/2004 | Ferrie et al. | 160/172 R |
| 2005/0092446 | A1 * | 5/2005 | Ni | 160/172 R |
| 2006/0169418 | A1 * | 8/2006 | Gromotka et al. | 160/107 |
| 2007/0089839 | A1 * | 4/2007 | Collum et al. | 160/168.1 R |
| 2007/0158035 | A1 * | 7/2007 | Larsson et al. | 160/168.1 R |
| 2009/0032203 | A1 * | 2/2009 | Liang | 160/178.1 R |
| 2009/0038762 | A1 * | 2/2009 | Hsieh | 160/168.1 R |

* cited by examiner

Section I-I

Section II-II

Section III-III

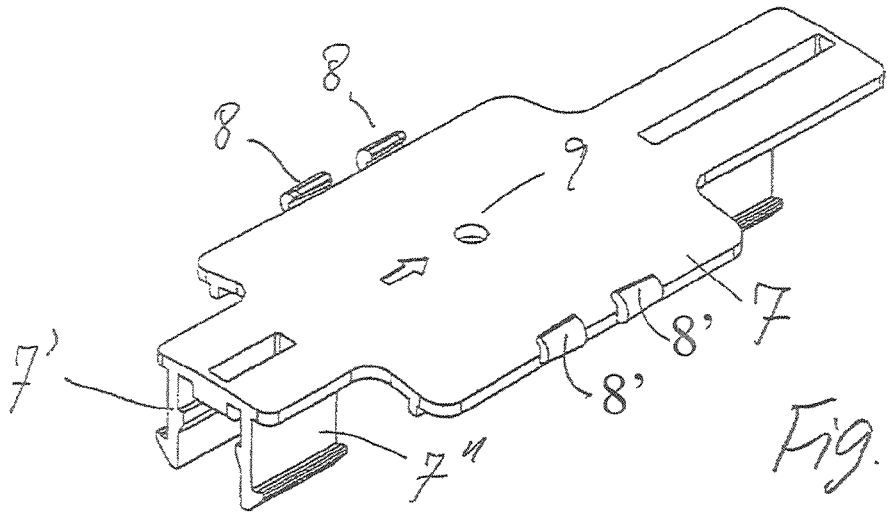
Fig. 6a
Fig 6b
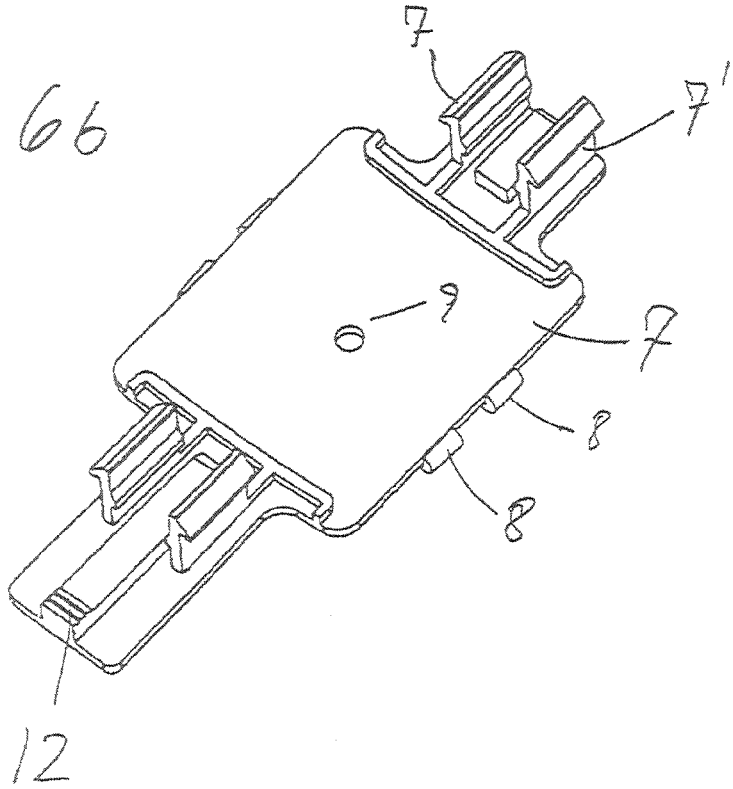

ADJUSTABLE BOTTOM RAIL FOR VENETIAN BLINDS AND USE OF ADJUSTMENT MEANS THEREFOR

FIELD

The invention concerns a bottom rail for Venetian blinds comprising means for fastening raising cords and ladder cords. The invention furthermore concerns the use of such fastening means.

BACKGROUND

Venetian blinds of the type that have freely suspended slats without side guides may be manufactured to precise measurements, i.e. with a pre-defined slat length and height of the Venetian blind, or else only the width and slat length are pre-defined by the width of a window, and the height of the Venetian blind must then be adjusted on location, so that the Venetian blind may be adjusted during use without any part rubbing against the window sill or the similar. A Venetian blind consists of a number of ladder cords that carry and adjust the angle of the slats, and raising cords or draw cords that pass through cut-outs in the slats and are fastened to the bottom rail. The adjustment of the angle is usually carried out by lifting one part of the ladder while lowering the other, and raising occurs by lifting the bottom rail by means of the raising cords, so that one slat after the other comes to rest on a pack of slats that increases in thickness. The bottom rail must have a certain stiffness so that the pack of slats may remain flat and not sag between the points of attachment of the raising cords. The ladder cords may either be adjusted by means of an operation that is separate from the raising function or else it is performed by reversing the direction of rotation of the same actuating device that also performs the raising. In the last instance the raising cords are wound around drums in the top rail.

The strings have to be fastened securely to the bottom rail, and various methods to obtain this are known, comprising threading them through holes that are provided for the purpose. A known solution uses holes in the upper side of a hollow bottom rail, through which the strings are threaded, whereupon a knot is tied or a lock is provided on the inside. This bottom rail is split lengthwise in two, and during the assembly the ladders are pinched at the outer edges. Thereby the bottom rail is made into a hollow profile with the desired stiffness. However, this solution suffers from the disadvantage that the adjustment is changed by the very clipping together of the two parts of the bottom rail.

SUMMARY

Systems are known using clips that may retain a C-shaped bottom rail for the raising cord and ladder tapes (an older solution for Venetian blinds), and which use the lowermost slat as a lid for the bottom rail, e.g. U.S. Pat. No. 2,627,917, but they have the disadvantage that special tools are required to cut the edges of the bottom rail to make room for the ladder tapes.

These disadvantages are avoided in a construction according to the invention which is particular in that the bottom rail is disposed as an essentially C-shaped profile, in which the inwards facing parts are suitable as recipients of hook-like fingers fitted onto clips that may pushed from above to engage the inwards facing parts and subsequently be shifted along the length of the profile, in that the clips have on their upper side hooks that are suited for gripping a slat for a Venetian blind on either side of a ladder cord and in that the clips each have a hole for fixing a raising cord. During installation a ladder may be be cut just below a rung that carries the lowermost Venetian blind slat, the raising cord may be pulled through the hole and provided with a thickening on the lower side, each clip may be clipped to the lowermost slat and finally be clipped into the C-shaped profile. A fine adjustment may be performed of the position of the clips in the bottom rail, and the installation may be finalized by fitting a cap at each end of the profile. Hereby the lowermost slat creates a lid for the bottom rail, where the thickness of the clip creates a small slit that provides character to the bottom rail by its shadow effect. Furthermore a last possibility for adjustment is achieved, even after installation, because the clips may be slid sideways out of the bottom rail, the height may be finally adjusted, and the clips may be clicked in place again. Furthermore the ladder is attached to the bottom rail in that the lowermost slat is fitted to the bottom rail, i.e. a completely normal placement of a ladder with respect to a slat.

An advantageous embodiment is particular in that a slider that is fitted between the hook-like fingers has means for gripping the end of a raising cord and may be displaced in the clip, lengthwise with respect to the bottom rail, for individual tightening of the raising cord. Hereby it is obtained in the manufacture of that type of Venetian blinds in which the raising cords are wound upon drums in the top rail, that the length of the raising cords, including a thickened end, may be decided at the time of manufacture. Fine adjustment occurs by equalizing the lifting forces in the individual raising cords, because the raising cords are adjusted individually by means of the slider until they participate equally in the raising.

A further advantageous embodiment is particular in that means have been provided to create friction, such as barbs, between the slider and the clip to maintain the slider in the final position. This embodiment is particularly advantageous when a tall Venetian blind is considered, in which the pulling force in a raising cord may be considerable.

BRIEF DESCRIPTION OF THE DRAWINGS

The invention furthermore comprises the use of a clip as defined in the claims.

The invention will be described further in the following, where

FIGS. 6*a* and 6*b* show a clip according to the invention.

DETAILED DESCRIPTION

Figure 1:
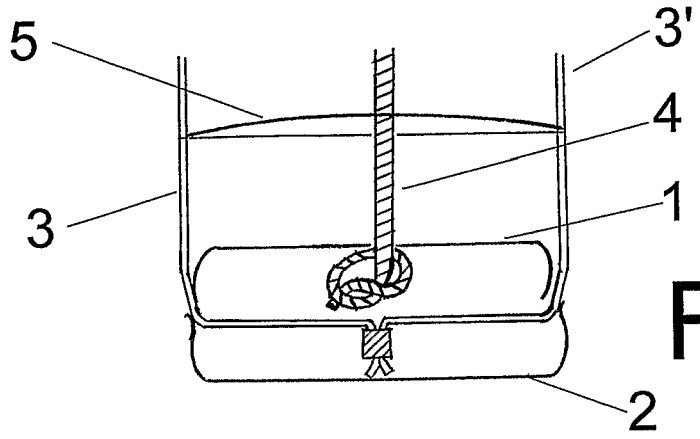
FIG. 1 shows a known solution for fixing of cords in a bottom rail.

In FIG. 1 is seen a known bottom rail that consists of two parts 1 and 2 that are clipped together to create a closed profile. The ladder cords 3 and 3' are held firmly between the two profiles 1 and 2, and the raising cord 4 has been pulled through a hole in the upper part 1, and a thickening, such as a knot, has been provided for the cord 4. Furthermore, the lowermost slat 5 is shown.

Figure 2:
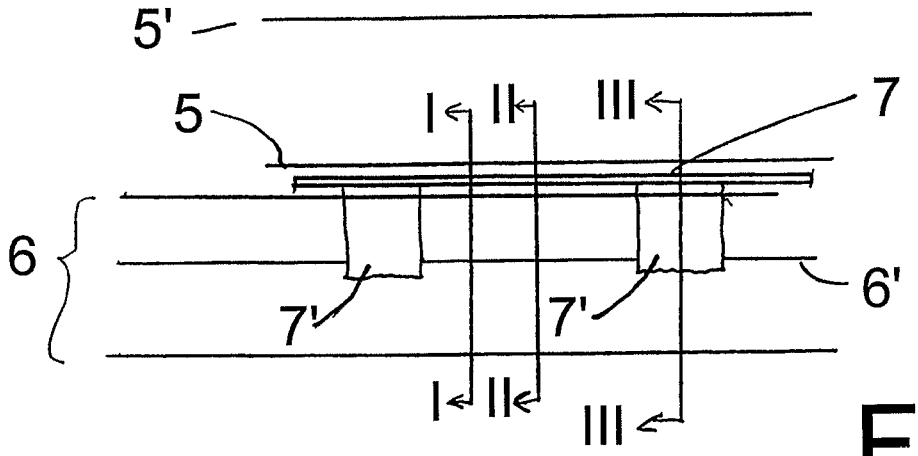
FIG. 2 shows a longitudinal section of the bottom rail according to the invention.

In FIG. 2 is shown a longitudinal section of a bottom rail 6 according to the invention, along one of the lengthwise inside edges 6', with a fitted clip 7. Furthermore, the lowermost slat 5 and the next-lowermost slat 5' are shown. By I-I is indicated the location of a first cross section through the bottom rail 6, the clip 7, and hooks 8, 8', and by II-II is shown the location of a second cross section through the bottom rail 6, the clip 7, and the raising cord 4. By III-III is shown a third cross section through the hook-like fingers 7' on the clip 7.

Figure 3:
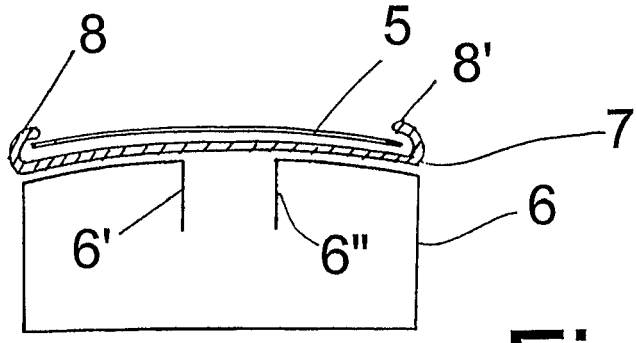
FIG. 3 shows a first cross section along the section I-I of the bottom rail according to the invention

In FIG. 3 is shown the cross section I-I. It will be seen that the lowermost slat 5 is held by the hooks 8, 8', and that it has a small distance to the bottom rail 6.

Figure 4:
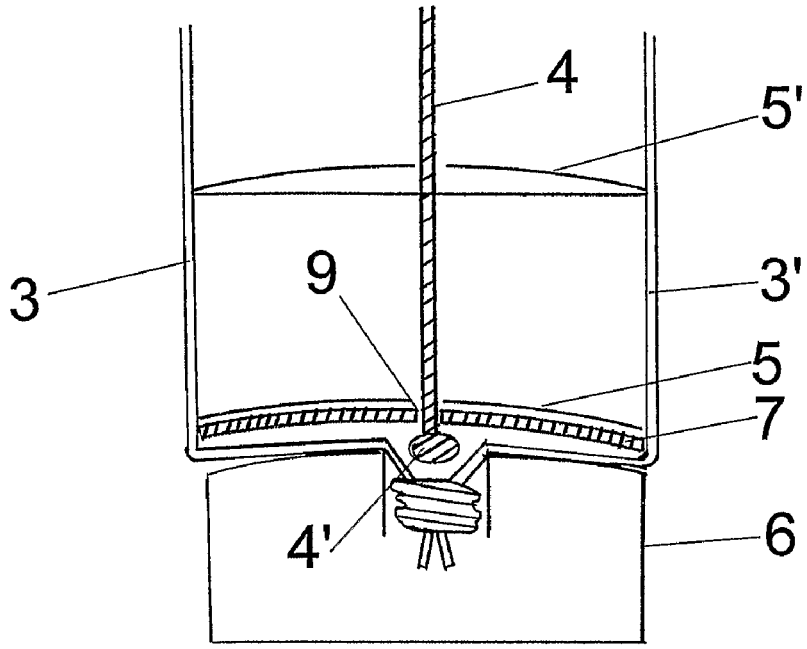
FIG. 4 shows a second cross section along the section II-II of the bottom rail according to the invention

In FIG. 4 is shown the cross section II-II. It will be seen that the ladder cords 3, 3' have been pulled under the clip 7 and brought between the clip and the bottom rail 6 until the space between the edges 6' and 6", where they are joined by means of a rivet or the like. The raising cord 4 is pulled through a hole 9 in the clip 7, and a tubular rivet 4' or the like is fitted to prevent its being pulled out.

Figure 5:
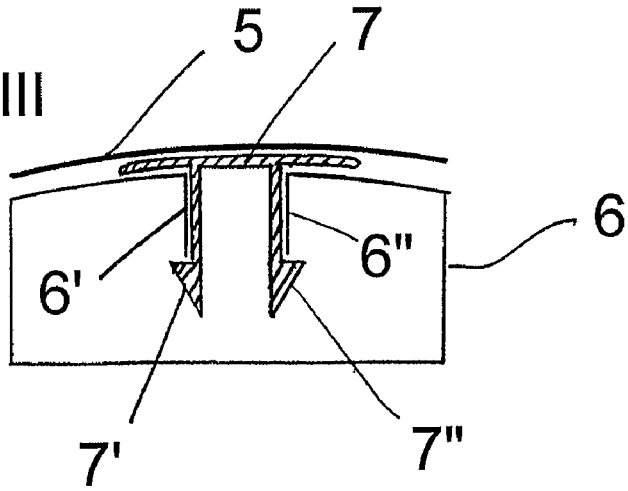
FIG. 5 shows a third cross section along the section III-III of the bottom rail according to the invention.

In FIG. 5 is shown the cross section HI-III. It will be seen that the clip 7 has oppositely directed hook-like fingers 7' and 7" that may engage below the edges 6' and 6" so that the bottom rail is fixed and may be lifted by pulling upwards on the clip 7.

In FIGS. 6*a* and 6*b* is shown a spatial representation of a clip according to the invention, in which a number of the features identified above may be seen.

Figure 7:
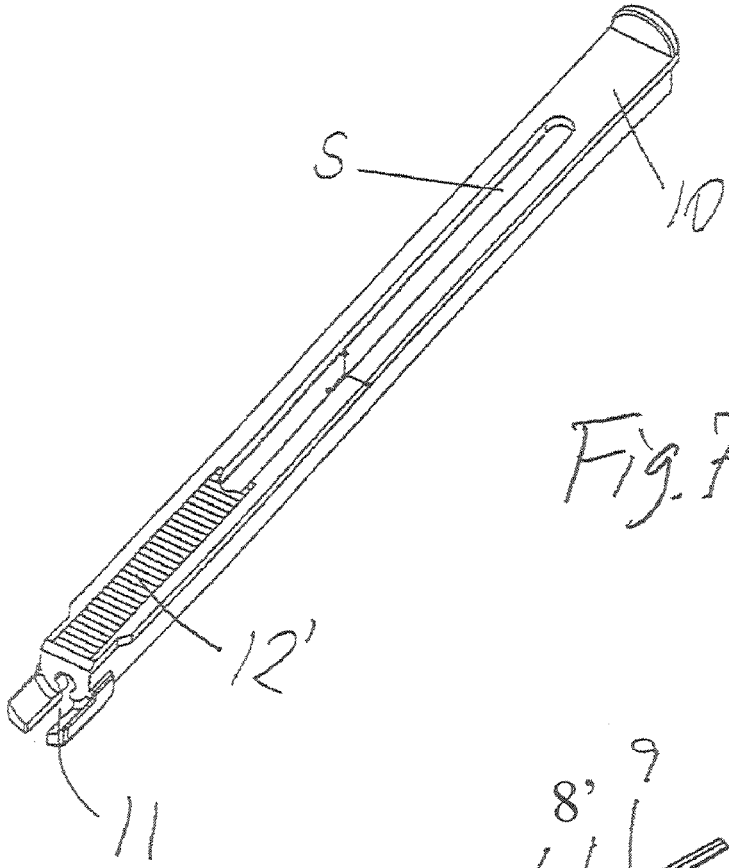
FIG. 7 shows a slider that may adjust the length of a raising cord.
Figure 8:
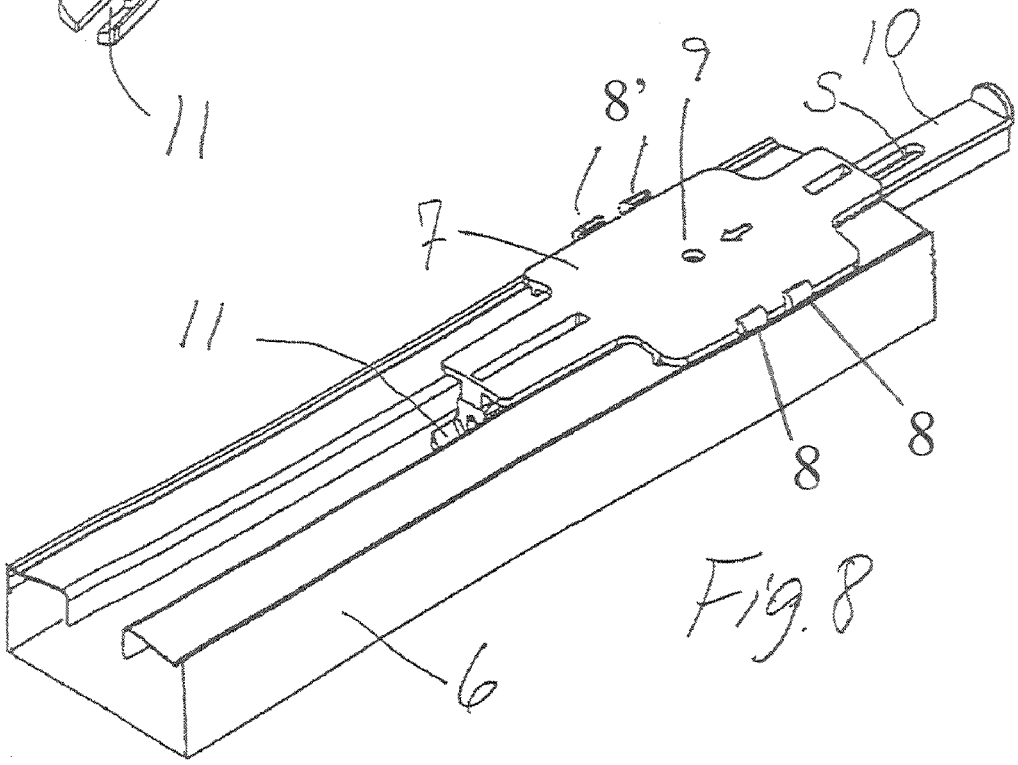
FIG. 8 shows a clip mounted on a bottom rail.

In FIG. 7 is shown a slider for tightening the raising cord. It is shown how one end 11 is shaped to grip a raising cord 4. This will pass vertically through the hole 9 in the clip 7, through the oblong slit S in the slider 10 and horizontally along the lower side of the slider 10, until the thickening 4' provides its end in the gripping means 11. There is furthermore shown a pinion-like corrugation 12' in the shape of a number of parallel barbs that cooperate with similar elements 12 on the clip 7. This serves to retain the slider in the position, in which a tightening of the raising cord has been obtained.

During installation a set of ladder cords 3, 3' may be cut just below a rung that carries the lowermost Venetian blind slat 5, the raising cord may be pulled through the slat and through the hole 9 in the clip 7 and be provided with a thickening, such as a rivet, on the lower side. Each clip 7 may be clipped to the lowermost Venetian blind slat by means of the hooks 8, 8', and may finally be clipped into the C-shaped profile 6. Fine adjustment of the position of the clips along the bottom rail 6 may be performed, and the installation may be finalized by means of a cap at each end of the profile. Thereby the lowermost slat 5 becomes a lid for the bottom rail 8, where the thickness of the rail creates a small slit that provides character for the bottom rail by its shadow effect. Furthermore the ladder cords 3, 3' are fixed to the bottom rail, because the lowermost slat is fitted to the bottom rail, i.e. a completely normal placement of a ladder with respect to a slat. The distance between the next-lowermost slat and the lowermost slat/bottom rail hence becomes quite habitual.

If there is a large discrepancy between the lengths of the raising cords, the clips may be slid lengthwise out of the bottom rail, so that the hook-like fingers 7, 7" are liberated, and the thickening 4' may be fitted correctly to the raising cord 4. The clips 7 may be clipped back in place in order that the hook-like fingers 7, 7" engage the inwards facing parts 6', 6" on the bottom rail 6.

There is furthermore a possibility of adjustment even after the installation by the use of the slider 10, in that the lifting force or the height may be finally adjusted by displacement of the slider 10. This requires that the means 11 are brought in engagement with the thickening 4' of the raising cord 4. The means 11 may be fork-shaped or guide in a V-shape towards a hole that pinches the raising cord 4. The established correct position of the slider 10 is maintained by the barbs 12' that are established in the slider 10 for cooperation with a similar structure 12 on the clip 7. In case an unforeseen stretching or shrinking of a raising cord should occur immediately subsequent to installation or after it has seen some use, a post-adjustment may be made by freeing the lowermost slat from the hooks 8 on each clip 7, the raising cord in question may be adjusted by displacing the slider 10 in the gap between the two parts 6', 6" in the bottom rail, and the lowermost slat 5 is again clipped on.

The invention claimed is:

1. A bottom rail for a Venetian blind with a raising cord and a slat, the bottom rail comprising:

a) an essentially C-shaped profile extending along an elongated axis, the C-shaped profile including inwardly directed parts extending from an opening of the C-shaped profile in an inward direction toward an interior of the C-shaped profile;

b) a clip including side hooks for gripping a slat, a hole for receiving a raising cord, and hook-shaped fingers, wherein the clip is configured to be mounted to the bottom rail by inserting the hook-shaped fingers through the opening of the C-shaped profile to engage the inwardly directed parts of the C-shaped profile, wherein once mounted, the clip is fixed from moving relative to the bottom rail in an outward direction away from the interior of the C-shaped profile while being adjustable relative to the bottom rail in a direction parallel to the elongated axis;

c) a slider fitted between the hook-shaped fingers, wherein the slider is adjustable relative to the clip along the elongated axis of the C-shaped profile to tighten a raising cord; and d) a friction device between the slider and the clip to maintain the slider in a final adjusted position with respect to the clip, wherein the friction device comprises a plurality of barbs.

2. A method of assembling a Venetian blind including the bottom rail of claim 1, a plurality of slats, a ladder cord provided with a plurality of rungs supporting the slats, and a raising cord extending through a hole in each of the slats, the method comprising the steps of:

a) threading of the raising cord through the hole in the clip;

b) providing a thickening at the end of the raising cord;

c) fixing of the clip to a lowermost slat with the side hooks of the clip; and d) mounting of the clip to the bottom rail by inserting the hook-shaped fingers through the opening of the C-shaped profile, and thereafter engaging the inwardly directed parts of the C-shaped profile, wherein the mounted clip is fixed from moving relative to the bottom rail in the outward direction while being adjustable relative to the bottom rail in the direction parallel to the elongated axis.

3. The method of claim 2, further comprising the steps of:

a) gripping of the end of the raising cord with the slider; and b) tightening of the raising cord by adjusting the slider relative to the clip along the elongated axis of the C-shaped profile, wherein a final adjusted position of the slider with respect to the clip is maintained by the plurality of barbs.

4. The bottom rail of claim 1, wherein the bottom rail includes an overall length extending from one end of the bottom rail to a second opposed end of the bottom rail, and the C-shaped profile is substantially the same and unbroken throughout the overall length along the elongated axis.

5. A bottom rail for a Venetian blind with a raising cord and a slat, the bottom rail comprising:

a) an essentially C-shaped profile extending along an elongated axis, the C-shaped profile including inwardly directed parts extending from an opening of the C-shaped profile in an inward direction toward an interior of the C-shaped profile, wherein the bottom rail includes an overall length extending from one end of the bottom rail to a second opposed end of the bottom rail, and the C-shaped profile is substantially the same and unbroken throughout the overall length along the elongated axis;

b) a clip including side hooks for gripping a slat, a hole for receiving a raising cord, and hook-shaped fingers, wherein the clip is configured to be mounted to the bottom rail by inserting the hook-shaped fingers through the opening of the C-shaped profile to engage the inwardly directed parts of the C-shaped profile, wherein once mounted, the clip is fixed from moving relative to the bottom rail in an outward direction away from the interior of the C-shaped profile while being adjustable relative to the bottom rail in a direction parallel to the elongated axis;

c) a slider fitted between the hook-shaped fingers, wherein the slider is adjustable relative to the clip along the elongated axis of the C-shaped profile to tighten a raising cord; and d) a friction device between the slider and the clip to maintain the slider in a final adjusted position with respect to the clip, wherein the friction device comprises a plurality of barbs.

6. A method of assembling a Venetian blind including the bottom rail of claim 5, a plurality of slats, a ladder cord provided with a plurality of rungs supporting the slats, and a raising cord extending through a hole in each of the slats, the method comprising the steps of:

a) threading of the raising cord through the hole in the clip;

b) providing a thickening at the end of the raising cord;

c) fixing of the clip to a lowermost slat with the side hooks of the clip; and d) mounting of the clip to the bottom rail by inserting the hook-shaped fingers through the opening of the C-shaped profile, and thereafter engaging the inwardly directed parts of the C-shaped profile, wherein the mounted clip is fixed from moving relative to the bottom rail in the outward direction while being adjustable relative to the bottom rail in the direction parallel to the elongated axis.

7. The method of claim 6, further comprising the steps of:

a) gripping of the end of the raising cord with the slider; and b) tightening of the raising cord by adjusting the slider relative to the clip along the elongated axis of the C-shaped profile, wherein a final adjusted position of the slider with respect to the clip is maintained by the plurality of barbs.

* * * * *

UNITED STATES PATENT AND TRADEMARK OFFICE

CERTIFICATE OF CORRECTION

PATENT NO. : 7,766,068 B2
APPLICATION NO. : 11/817254
DATED : August 3, 2010
INVENTOR(S) : Andersen It is certified that error appears in the above-identified patent and that said Letters Patent is hereby corrected as shown below:

On the Title page, Item (30) "Foreign Application Priority Data" should reflect --March 1, 2005--, In column 3, line 9, please replace the first "II" with the letter --H--, In column 3, line 11, please replace the first "III" with the letter --H--, In column 3 line, 12, please replace "7"" with the letter --T--, In column 3, line 16, please replace the first "II" with the --H--, Signed and Sealed this Sixteenth Day of November, 2010

David J. Kappos

David J. Kappos
*Director of the United States Patent and Trademark Office*